United States Patent [19]

Robert

[11] 4,329,171

[45] May 11, 1982

[54] STEEL MAKING METHOD

[75] Inventor: Edgardo J. Robert, Buenos Aires, Argentina

[73] Assignee: Pennsylvania Engineering Corporation, Pittsburgh, Pa.

[21] Appl. No.: 223,365

[22] Filed: Jan. 8, 1981

[51] Int. Cl.[3] ..... C21C 5/34

[52] U.S. Cl. ..... 75/51; 75/52; 75/59; 75/60

[58] Field of Search ..... 75/51, 52, 59, 60

[56] References Cited

U.S. PATENT DOCUMENTS 3,953,199 4/1976 Michaelis ..... 75/60

4,089,677 5/1978 Spenceley ..... 75/60

*Primary Examiner*—P. D. Rosenberg

*Attorney, Agent, or Firm*—Fred Wiviott

[57] ABSTRACT

A method of producing steel from ferrous hot metal containing carbon includes the steps of delivering oxygen and a surrounding sheath of hydrocarbon shielding fluid to the metal and beneath its surface to elevate the temperature to about 1350° C. Pelletized iron material and carbon are then simultaneously delivered to the metal at controlled rates with the rate of carbon delivery being regulated so that the carbon level within the metal maintains in substantial equilibrium. After charging of the pellets has been completed, the delivery of carbon is terminated while the delivery of oxygen and hydrocarbon shielding fluid is continued until the metal carbon level is reduced a desired level.

1 Claim, 1 Drawing Figure

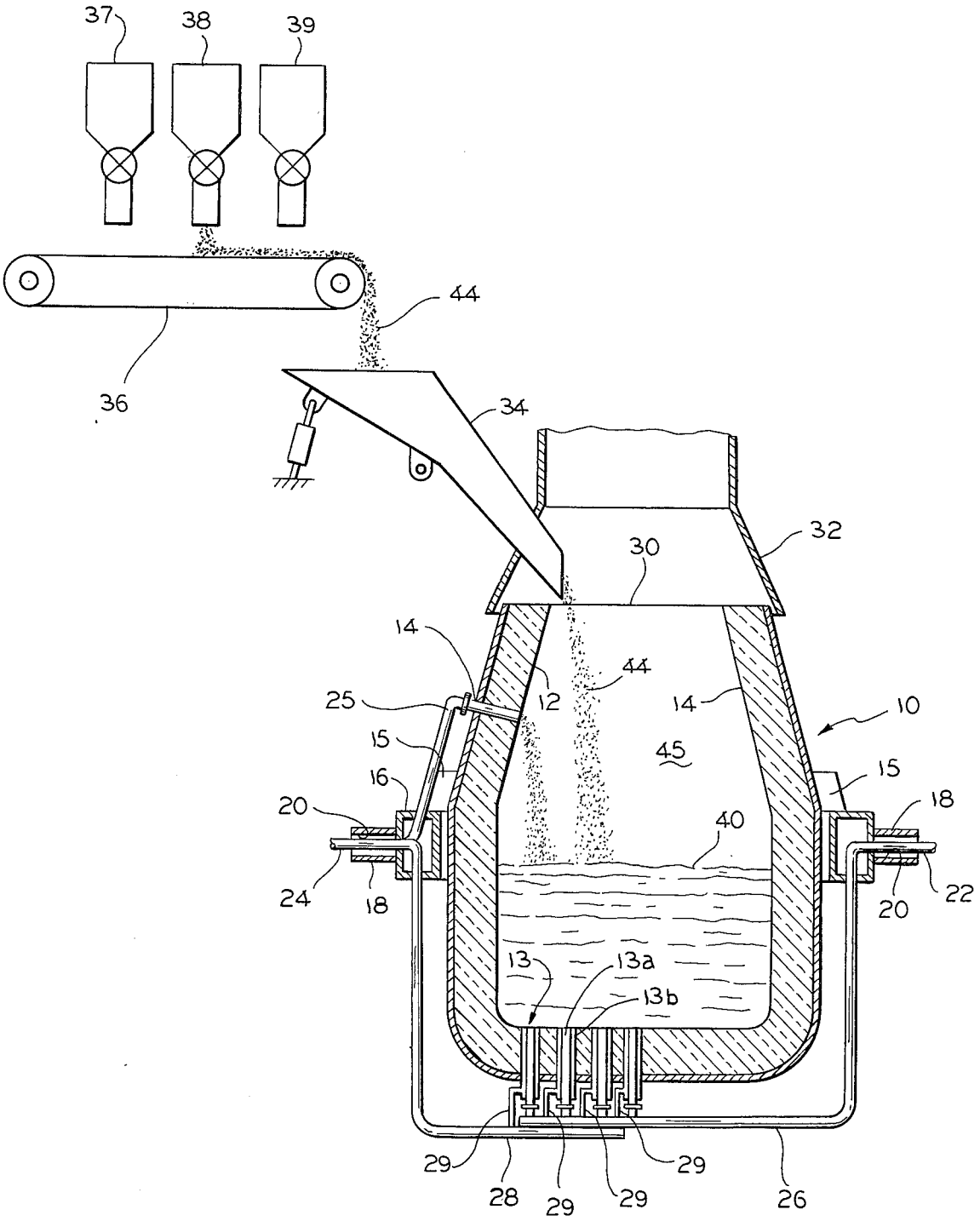
37
38
39
44
36
34
32
30
14
44
25
12
14
10
15
45
16
15
20
18
40
24
18
20
22
13
13a
13b
29
28
29
29
29
26

STEEL MAKING METHOD

BACKGROUND OF THE INVENTION

This invention relates to a bottom-blown steel making process.

One well-known steel making process involves refining pig iron by top or bottom blowing with oxygen. When bottom blowing is employed, a sheath of hydrocarbon shielding fluid, such as propane, natural gas or light oil is injected in surrounding relation to the oxygen in order to prolong tuyere and refractory life. Because solid iron bearing materials, such as scrap and prereduced pelletized iron are relatively cheaper than hot metal, it is often desirable in such processes to employ a solid charge to the extent possible. The percentage of solid metal to hot metal charge is generally limited by the heat generated during the exothermic reactions between the oxygen and impurities in the hot metal, such as carbon, silicon, phosphorous and manganese.

The proportion of solid charge may be increased somewhat by using the bottom tuyeres as preheating burners. Such tuyeres generally include an inner pipe for carrying oxygen and a second pipe spaced from the inner pipe to provide an outer annulus for delivering the hydrocarbon shielding fluid. In such tuyeres, the area of the gap between the pipes is relatively much smaller than the area of the inner oxygen carrying pipe because the volume of shielding fluid required during normal operation is only about 2–4% of the volume of oxygen. This severely restricts the capacity of such tuyeres to act as preheating burners because the relatively small area of the outer annulus severly limits the quantity of hydrocarbon that can be provided for preheating. One attempt to increase the hydrocarbon available for preheating involves the use of a dual supply system for providing hydrocarbon in liquid form during preheating and in gaseous form during refining. This system, while satisfactory, complicates the fluid delivery system which normally passes through the vessel's trunnion pins.

A steel making process which would permit an increase in the percentage of solid furnace charge without the necessity for special fluid delivery systems would be an advancement in the art.

SUMMARY OF THE INVENTION

It is an object of the invention to provide a new and improved steel making process.

Another object of the invention is to provide a steel making process which permits the use of a solid furnace charge without the necessity for specialized fluid delivery systems.

A further object of the invention is to provide a steel making process which utilizes a cold charge other than scrap.

Yet another object of the invention is to provide a pneumatic steel making process in which the furnace charge includes partially prereduced iron pellets.

These and other objects and advantages of the present invention will become more apparent from the detailed description thereof taken with the accompanying drawing.

In general terms, the invention comprises a method of producing steel from ferrous hot metal containing carbon, comprising the steps of delivering oxygen and a surrounding sheath of hydrocarbon shielding fluid to the hot metal and beneath its surface to elevate the temperature thereof to a preselected level, delivering prereduced or partially prereduced iron or iron ore pellets pelletized iron to the metal at a controlled rate, the pellets tending to lower the temperature of said metal, delivering carbon to said metal at a controlled rate and simultaneously with the delivery of said pellets, the feed rate of carbon being regulated to maintain the carbon level in the metal at a substantially constant level as the same is oxidized by said oxygen, and terminating the delivery of pellets and carbon to the metal while continuing to deliver oxygen and shielding fluid to reduce the level of carbon therein to a preselected level.

BRIEF DESCRIPTION OF THE DRAWINGS

The single FIGURE of the drawing schematically illustrates the vessel in which the process according to the invention may be carried out.

DESCRIPTION OF THE PREFERRED EMBODIMENT

The method of the invention may be carried out in the vessel 10 shown in the drawing, although those skilled in the art will appreciate that it is exemplary. The vessel 10 is generally pear-shaped in vertical secton and includes a metallic shell 11 and a refractory lining 12. A plurality of tuyeres 13 extend through the lower end of the vessel and each includes an inner pipe **13*a* and a concentric outer pipe 13*b* spaced from the inner pipe to permit the injection of oxygen and a surrounding sheath of hydrocarbon shielding fluid. In addition, one or more tuyeres 14** may extend through the vessel refractory adjacent its upper end for purposes which will also be discussed more fully below.

Converter vessels of the type illustrated are generally supported in a conventional manner by means of a plurality of peripherally spaced apart brackets 15 which engage and are releasably secured to a hollow trunnion ring 16 surrounding the vessel 10. Trunnion pins 18 extend from each of the opposite sides of ring 15 and are suitably supported in a well-known manner on conventional bearing structures (not shown) and one trunnion pin is coupled to a suitable driver mechanism (not shown) for tilting the vessel to each of a plurality of positions as may be required during a process cycle.

The trunnion pins 18 may each have a hollow bore 22 for respectively receiving gas delivery pipe 22 and hydrocarbon shielding delivery pipes 24 and 25. Additional pipes (not shown) may also be provided for delivering cooling water to the hollow trunnion ring 16 and other areas of the vessel, and particularly those portions adjacent its upper end. Pipe 22 is connected at its lower end to a first manifold 26 which in turn is connected to each of the central tuyere pipes **13*a*. Similarly, the hydrocarbon shielding fluid delivery pipe 24 is connected at its lower end to a manifold pipe 28 which in turn is connected by short feeder pipes 29 to the gap between tuyere pipes 13*a* and 13*b* and the hydrocarbon delivery fluid pipe 25 is similarly connected to the upper tuyeres 14. For a more detailed description of the manner that pipes 22, 24 and 25 are passed through trunnion pins 16 and 18** and the manner in which the same are connected to upper and lower tuyeres, reference is made to U.S. Pat. No. 3,810,297.

Disposed above the open upper end 30 of the vessel 10 is the movable skirt 32 of a gas collecting hood which is connected to a conventional gas cleaning system (not shown) in a well known manner. The lower end of a charging chute 34 extends through hood 32 and its upper end is positioned for receiving solid charging materials from a conveyor 36 positioned below material storage hoppers 37, 38 and 39.

In practicing the process of the invention, the vessel 10 is first charged with molten pig iron which may typically contain about 3–4% carbon, 0.7% silicon 7% manganese. During charging, an inert gas, such as argon or nitrogen is delivered to each of the tuyere pipes 13*a* and 13*b* to prevent the backflow of metal into the tuyeres 13. After charging with hot metal has been completed, oxygen is delivered to the inner tuyere pipe 13*a* and a hydrocarbon shielding fluid to the outer tuyere pipe 13*b*. Powdered lime or some other fluxing agent may be entrained in the oxygen stream. The level of shielding fluid delivered will be about 2–4% by volume of oxygen.

As a result of the exothermic reactions between the oxygen and the carbon, silicon and other impurities in the hot metal, a substantial amount of heat will be generated. When the temperature of the liquid metal reaches about 1350° C., prereduced or partially reduced iron ore pellets are delivered from one of the hoppers 37, 38 or 39 to the conveyor which in turn deposits the same in the upper end of the chute 34. The pellets are then fed from chute 34 at a controlled rate into the furnace path 40. Simultaneously with the delivery of prereduced iron 44, a measured quantity of carbon, in the form of oil or as dry powder, will also be delivered to the furnace bath. This may be done either through the upper tuyere 14 or some other convenient method.

The prereduced or partially prereduced iron ore pellets will have a tendency to chill the melt which must be balanced by the oxidation of the carbon addition. Therefore, carbon will be fed into the vessel at a rate which will maintain the level of carbon in the bath 40 at an equilibrium level. In this manner, the temperature of the bath can be maintained at about 1350° C. during the charging of the pellets 44. In the event the pellets are not completely reduced, that is, if they retain some oxygen, the level of the oxygen fed into the vessel can be reduced accordingly.

The rate at which the iron pellets will be fed into the furnace will depend upon the cold charge rate desired, but is in the range of 0.6 to 1.5 kg/ton of liquid steel per minute per each percent of cold charge rate. The rate of carbon charge will depend upon the chemical analysis of the prereduced iron, and in particular to the iron oxide content.

After the charge of prereduced iron has been completed, the delivery of carbon will also be terminated. The blowing of oxygen and hydrocarbon shielding fluid will be continued, however, until the levels of carbon, silicon and manganese are reduced to desired levels. Lime may also be delivered to the bath 40 in any convenient manner, such as by being entrained in powdered form in the oxygen stream. At the end of the oxygen blow, carbon may be injected to bring the carbon level in the bath within the desired specification and iron oxide may be injected for temperature control. Upon the completion of the oxygen blow, inert gases will again be delivered to the lower tuyeres while the hot metal is being poured.

While only a single embodiment of the invention has been illustrated and described, it is not intended to be limited thereby but only by the scope of the appended claims.

I claim:

1. A method of producing steel from ferrous hot metal containing carbon, comprising the steps of:

delivering oxygen and a surrounding sheath of hydrocarbon shielding fluid to said metal and beneath its surface to elevate the temperature thereof to about 1350° C., delivering pelletized iron material which is at least partially prereduced to said metal at the rate of 0.6–1.5 Kg/ton of liquid steel per minute per each percent of cold charge said pellets tending to lower the temperature of said metal, delivering carbon to said metal at a controlled rate and simultaneously with the delivery of said pellets, the feed rate of said carbon being such as to maintain the carbon level in said metal at a substantially equilibrium level as the same is oxidized by said oxygen, terminating the delivery of pellets and carbon to said metal while continuing to deliver oxygen and shielding fluid to reduce the level of carbon therein to a preselected level.

* * * * *